US006491459B2

(12) United States Patent
Hosomi

(10) Patent No.: US 6,491,459 B2
(45) Date of Patent: Dec. 10, 2002

(54) PRINTER WITH FIRST AND SECOND SWING COVERS

(75) Inventor: Hiroaki Hosomi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/736,390

(22) Filed: Dec. 15, 2000

(65) Prior Publication Data

US 2001/0016135 A1 Aug. 23, 2001

(30) Foreign Application Priority Data

Dec. 15, 1999 (JP) ..... 11-356512

(51) Int. Cl.[7] ..... B41J 15/04
(52) U.S. Cl. ..... 400/613; 400/693
(58) Field of Search ..... 400/671, 693, 400/613, 621, 663

(56) References Cited

U.S. PATENT DOCUMENTS

| | | | | |
|---|---|---|---|---|
| 5,030,968 A | | 7/1991 | Benson et al. | 347/222 |
| 5,137,385 A | * | 8/1992 | Kamimura et al. | 400/690.4 |
| 5,188,029 A | | 2/1993 | Sugimoto et al. | 101/288 |
| 5,229,587 A | | 7/1993 | Kimura et al. | 235/432 |
| 5,672,020 A | | 9/1997 | Leonard et al. | 400/690.4 |
| 5,820,068 A | * | 10/1998 | Hosomi et al. | 242/563 |
| 6,092,945 A | * | 7/2000 | Takami et al. | 101/288 |

FOREIGN PATENT DOCUMENTS

| | | |
|---|---|---|
| DE | 32 46 563 A1 | 6/1984 |
| EP | 0 764 585 A1 | 3/1997 |
| EP | 0 925 947 | 6/1999 |
| JP | 59-41290 | 3/1984 |
| JP | 4-201835 | 7/1992 |
| JP | 6-166227 | 6/1994 |
| JP | 8-295323 | 11/1996 |
| JP | 2633726 | 4/1997 |

OTHER PUBLICATIONS

Patent Abstract of Japan, vol. 13, No. 400 (M–867), Sep. 6, 1989 and JP 1–145176, Jun. 1989.

* cited by examiner

*Primary Examiner*—Daniel J. Colilla
(74) *Attorney, Agent, or Firm*—Nixon & Vanderhye P.C.

(57) ABSTRACT

A printer having an opening provided on an accommodating portion for a recording rolled paper, wherein the opening is covered by first and second swing covers which pivot in opposite directions when moving from a closed position in which they are relatively close to each other. The first swing cover has a first guide member, and the second swing cover has a second guide member. After loading the recording rolled paper into the accommodating portion, the first swing cover is firstly closed. Then, the second swing cover is closed so that the label sheet is automatically arranged to curve by passing around the first guide member and the second guide member.

19 Claims, 15 Drawing Sheets

PRINTER WITH FIRST AND SECOND SWING COVERS

BACKGROUND OF INVENTION

1. Field of Invention

This invention relates to a printer having a structure for printing a recording paper fed from a recording rolled paper such as a rolled label sheet with base sheet and for separating a label from a base sheet after printing. Specifically, the invention relates to a printer in which a recording rolled paper loading operation becomes easy.

2. Related Art

In general, at a shopping center, a distribution center or the like, a label which indicates the final destination or the like is attached to cargo to be delivered. Normally, the printing operation is applied to the labels adhered on a base sheet. Then, the labels are separated one by one from the base sheet and are attached to the cargo.

Conventional printers for this purpose are disclosed in Unexamined Japanese Patent Publication Hei. 8-295323, Japanese Patent 2633726 or the like. These publications show a separating structure wherein the labels are automatically separated from the base sheet after printing.

As shown in these publications, a label printer includes a roll-accommodating portion in a body. The recording rolled paper is accommodated in this portion, and the label sheet is fed from this portion. After passing through a printing portion, the printed labels are separated from the base sheet by transporting the label sheet through a transporting path with a curled portion. Then, the label is discharged from a discharging port formed on a cover of the roll accommodating portion.

In the above-described construction, it is preferable to be able to easily operate the cover when the recording rolled paper is loaded. Further, when new roll paper is loaded, it is preferable to easily satisfy the condition by a simple operation, that is, the label sheet fed from a recording rolled paper travels along the transporting path with the curled portion, as a constituent of the separating structure, and is pulled off to an external portion of the printer body.

3. The Problem to be Solved

In this kind of the label printer, however, a space for opening the cover is required in vicinity of the printer. When the cover is designed as a swing cover—wherein two swing covers pivot in opposite directions when moving from a closed position in which they are relatively close to each other—the necessary space for two doors is smaller than that for a single cover. This is desirable.

But if two swing covers are used, it is necessary to operate each swing cover. Further, if the covers must be opened in turn, an operation error tends to occur.

SUMMARY OF INVENTION

An object of the present invention is to provide a printer in which an printer body has a recording rolled paper accommodating portion that includes an opening portion constituted by swing covers pivoting in opposite directions when moving away from the positions in which they are relatively close to each other wherein as the swing covers are being closed, the label sheet fed from a recording rolled paper travels along a transporting path so as to have a curled portion—as a constituent of the separating structure—and is pulled off to an external portion of the printer body.

Another object of the present invention is to provide a printer having a pair of swing covers wherein an open/close operation becomes easy.

In view of the above objects, according to a first aspect of the present invention, there is provided a printer comprising:

a printer body having an accommodating portion for accommodating a rolled paper;

a opening for loading the rolled paper into the accommodating portion;

first and second swing covers, for opening and closing the opening, the first and second swing covers being mounted to the printer body so as to move away from a closed position in which they are close to each other;

a printing head which prints on the paper fed from the rolled paper accommodated in the accommodating portion;

a platen member mounted on the first swing cover and confronted with the printing head portion when the first swing cover is closed;

a first guide member provided with the first swing cover, and positioned downstream, in a paper transporting direction, with respect to the printing head and the platen member when the first swing cover is closed; and a second guide member, provided with the second swing cover, the second guide member positioned in vicinity of the first guide member when the first and second swing covers are closed, wherein the first and second guide members guide the paper so as to incurvate the paper on the first guide member.

According to the present invention, a separator defined by the first guide member transports the label sheet along the curved transporting path, and such is automatically accomplished by closing the first and second swing covers.

When the first and second swing covers are closed, the first guide member is positioned on the same side of the thermal printing head as is the platen member. Also, the second guide member is positioned at the same side of the first guide member. If the second guide member is set far from the first guide member, the separator for transporting the recording medium along with the curved transporting path becomes simple.

Further, the second guide member is defined by a sheet-pressing roller adjustably mounted, on the second swing cover, in the sheet pressing direction. An elastic member urges the sheet-pressing roller in the sheet pressing direction.

In the above-described construction, the label sheet is wound by the first guide member—urged by the elastic force of the elastic member—with a predetermined tension. Thus, the label is separated from the base sheet.

Next, the printer of the present invention may employ a lock mechanism for locking the first and second swing covers in a closed condition.

The lock mechanism contains a lock lever mounted on one of the first and second swing covers, a cover-side lever-engagement portion provided with the other swing cover, and a main-body-side lever-engagement portion. When the first and second swing covers are closed, a cover-side engagement portion located on the lock lever is engaged with the cover-side lever-engagement portion, and a main-body-side engagement portion is engaged with the main-body-side lever-engagement portion.

In this construction, when the swing cover which does not have the lock lever is firstly closed, the swing cover is not locked. Thus, the operator must perform a closing operation such that the pair of swing covers is closed in the predetermined turn, whereby the second guide member surely separates the label from the base sheet.

Further, a single lock lever locks both swing covers, thereby simplifying the open/close operation.

The cover-side engagement portion and the main-body-side engagement portion rotate between a lock position (wherein the cover-side engagement portion and the main-body-side engagement portion engage with the cover-side lever-engagement portion and the main-body-side lever-engagement portion, respectively) and an unlock position (wherein these engagements are released). Further, the lock mechanism further contains an elastic member for urging the lock lever to the lock position, a manual operating member for rotating the lock lever toward the unlock position against an urging force of the elastic member, and an urging member for urging the swing cover—which is not provided with the lock lever—in a swing-cover opening direction.

Instead of the construction described above, the lock mechanism may contain a lock lever mounted on the second swing cover, a first-swing-cover pressing portion provided with the second swing cover, a main-body-side lever-engagement portion provided with a printer main body, and a main-body-side engagement portion engaged with the main-body-side lever-engagement portion when the lock lever closes the second swing cover, wherein a first swing cover pressing portion provided with the second swing cover presses the first swing cover to a closing direction thereof when the second swing cover is closed.

In this construction, one swing cover maintains the other swing cover in the closed condition. Thus, when the one swing cover, which does not have the lock lever, is firstly closed, it is not fixed in the closed condition.

In this case, the first-swing-cover pressing portion corresponds to the second guide member, and it is preferable that the second guide member is capable of pressing the platen member provided with the first swing cover toward the closing direction when the second swing cover is closed.

Further, it is preferable that the lock mechanism further contains an urging member for urging the second swing cover in the opening direction. In this construction, when the first swing cover is opened, the second swing cover which was held in the closed condition is automatically opened.

Moreover, the printer of the present invention contains a cutter blade for cutting the recording medium after printing. The cutter blade is positioned downstream—in the recording medium feeding direction—of the printing head and the platen member.

In this situation, an opening for discharging the recording medium is provided by the first and second swing covers, at a position adjacent the printing head portion and the platen member, when the first and second swing covers are closed. And the cutter blade is positioned adjacent to the opening for discharging the recording medium. With this construction, upon closing the first and second swing covers, the cutter blade could cut the label sheet or the like. It is possible to provide the cutter blade with the first guide member.

Next, according to the present invention, the printing head includes a thermal head, and the platen member includes a platen roller. In this case, when the first cover is closed, the platen roller is brought into contact with the thermal head.

BRIEF DESCRIPTION OF DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS

Figure 1:
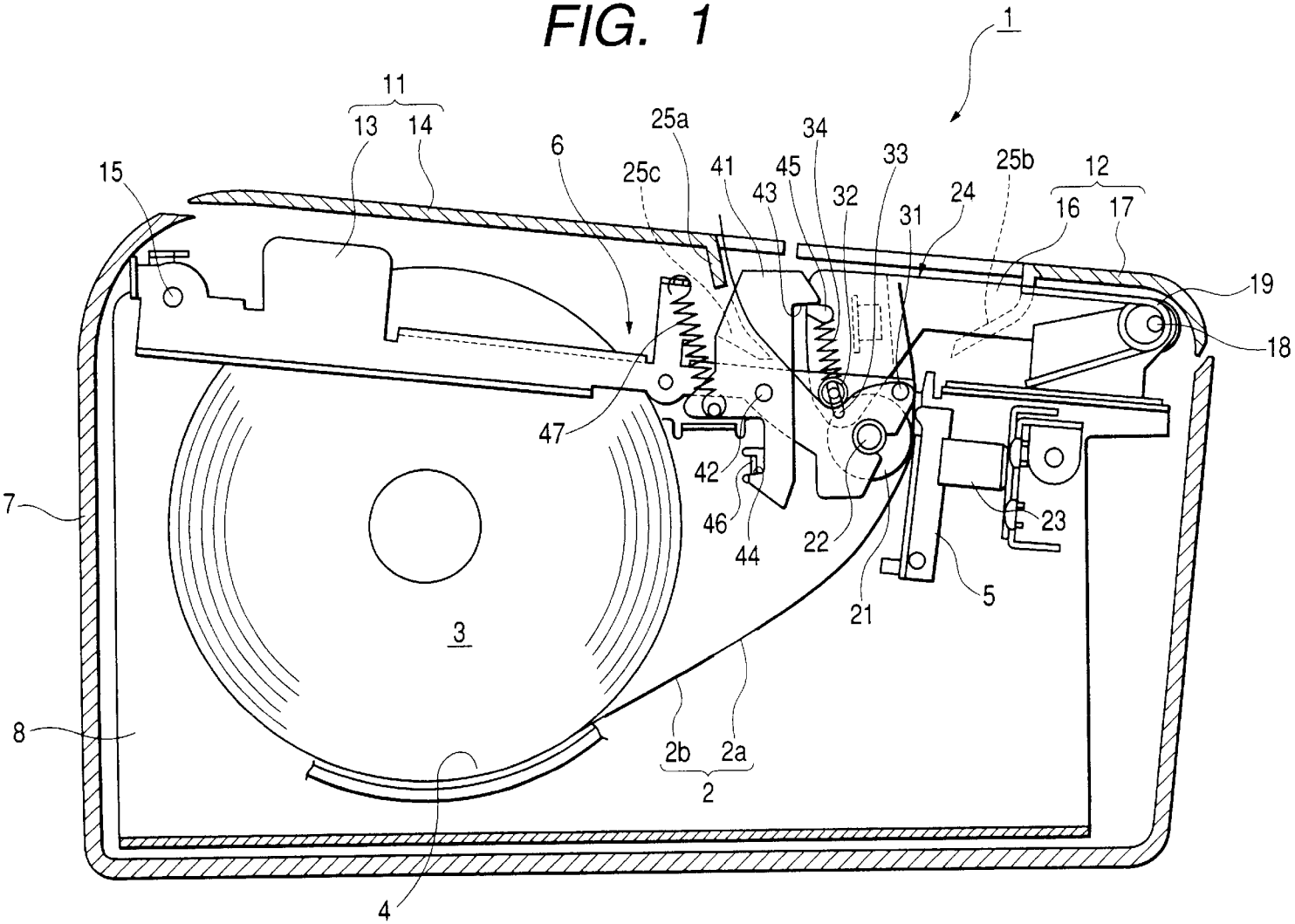
FIG. 1 is a side view showing a schematic configuration of a printer according to an embodiment of the invention.

Referring to the drawings, preferred embodiments of a printer according to the present invention will be described in detail below.

Figure 2:
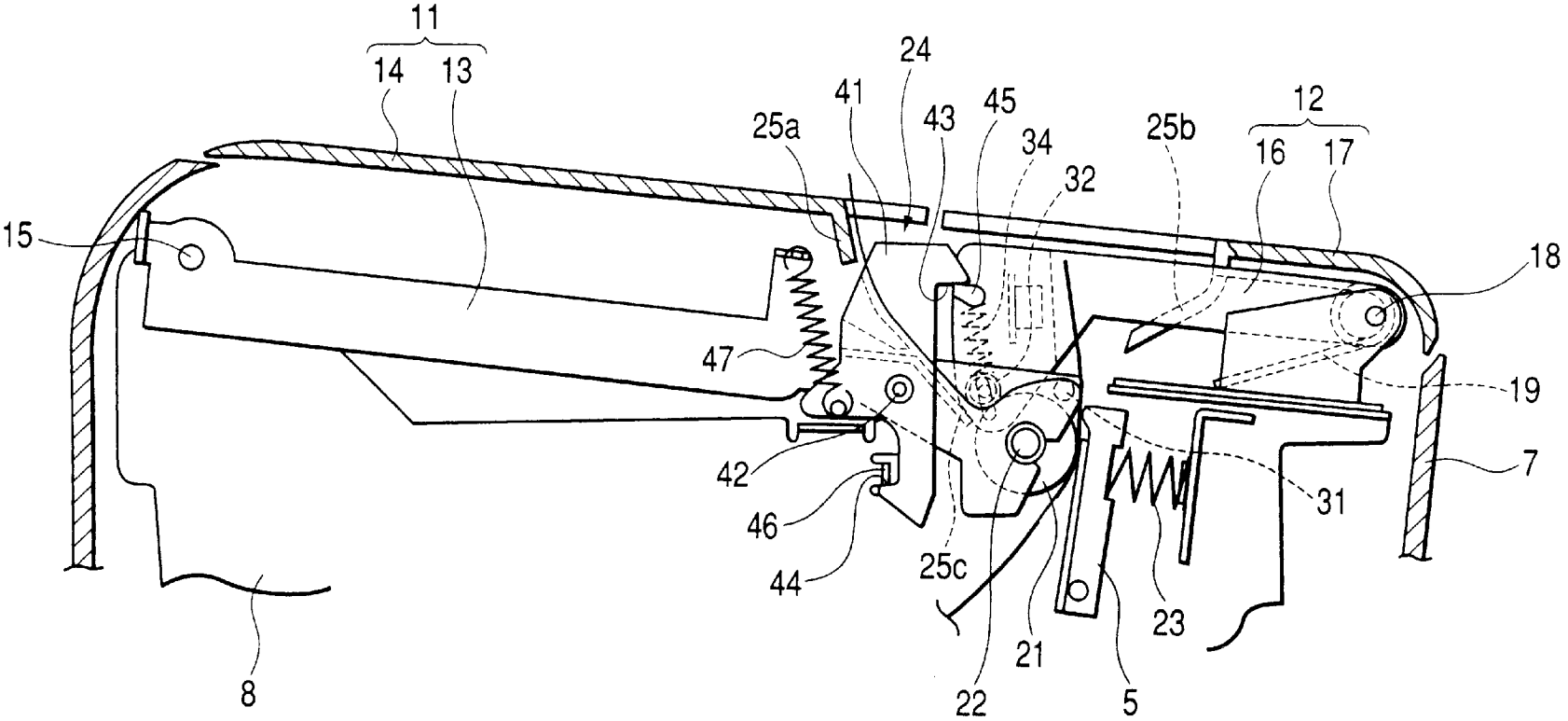
FIG. 2 is a side view showing both swing covers closed.

FIG. 1 is a perspective sectional view of a main part of a label printer of the present invention. FIG. 2 is an enlarged partial sectional view of FIG. 1.

According to this embodiment of the present invention, a label printer 1 includes an accommodating portion 4 which holds a recording rolled paper 3 having a label sheet 2 wherein labels 2*b* are adhered on a tape like base sheet 2*a* having a constant width. A thermal head 5 prints the label 2*b* of the label sheet as the label sheet is fed from the recording rolled paper. Further, the label 2*b* is separated from the base sheet 2*a*, after printing, to discharge it out of the printer body. Of course, the label printer 1 is capable of printing on a normal (non-label) recording paper.

As shown in FIGS. 1 and 2. the label printer 1 has a rectangular shaped main case 7. The main case 7 contains a main frame 8, made of metal or the like, having a pair of side plates parallel to each other with a predetermined distance defined therebetween. The side plates are mounted so that the predetermined distance extends along a width direction of the printer. The accommodating portion 4 is designed to feed the recording rolled paper 3 from an opening 6 in the main case 7, and is arranged between the pair of side plates of the main frame 8. Further, a thermal head 5 is mounted on a front portion of main frame 8.

The opening 6 is closed by a first swing cover 11 and a second swing cover 12 which pivot in opposite directions when moving away from a closed position wherein they are relatively close to each other. The first swing cover 11 includes a first cover frame 13 and a first cover case 14 attached to the first cover frame 13.

The first cover frame 13 is rectangularly shaped, and a proximal end thereof is rotatably supported by a first axis 15 bridged to the main frame 8 in the width direction. Similarly, a second swing cover 12 has a second cover frame 16 and a second cover case 17.

Figure 3A:
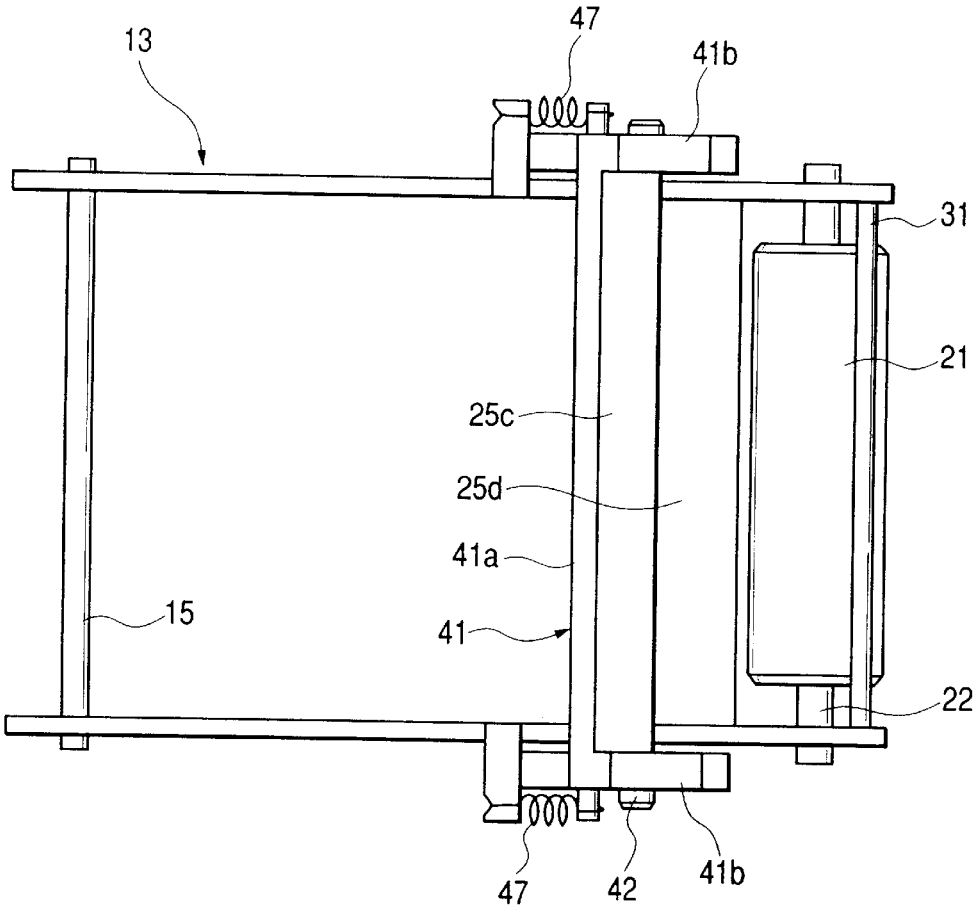
FIGS. 3 (*a*) and (*b*) are a plan view and a partial side view, respectively, of a first cover frame of a first swing cover of the printer in FIG. 1.
Figure 3B:
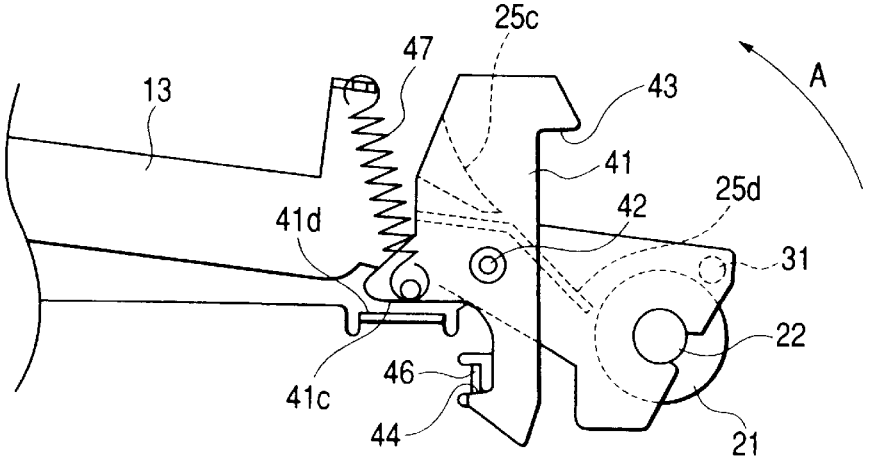
Figure 4A:
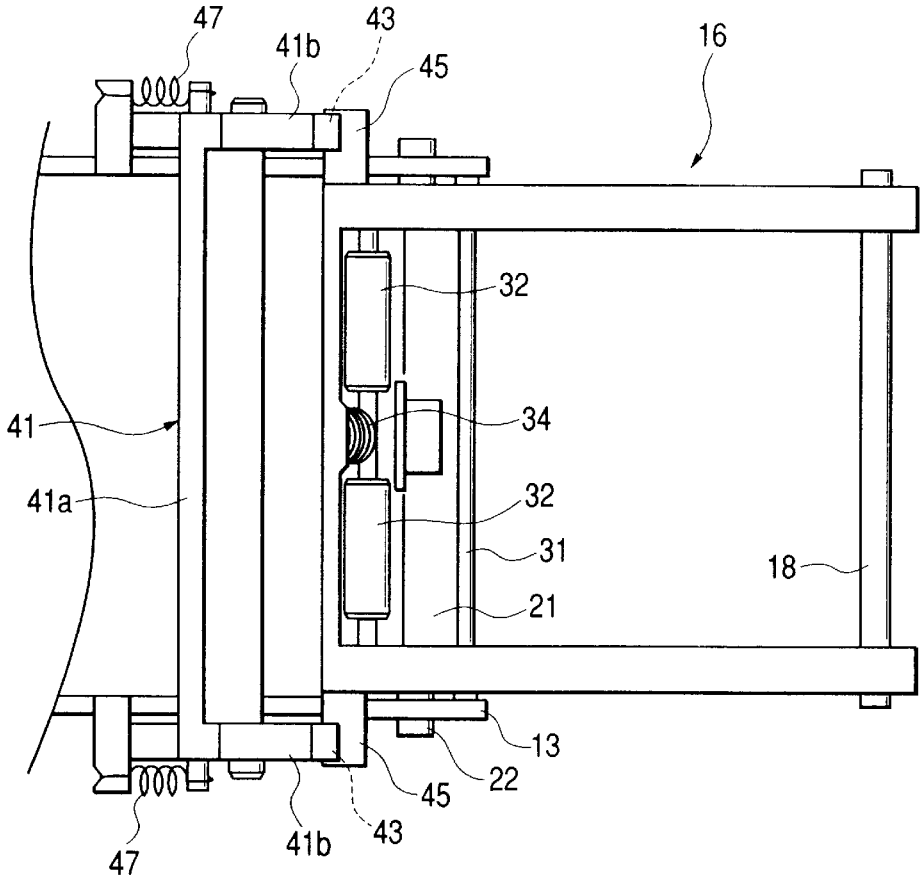
FIGS. 4 (*a*) and (*b*) are a plan view and a partial side view, respectively, of a second cover frame of a second swing cover of the printer in FIG. 1.
Figure 4B:
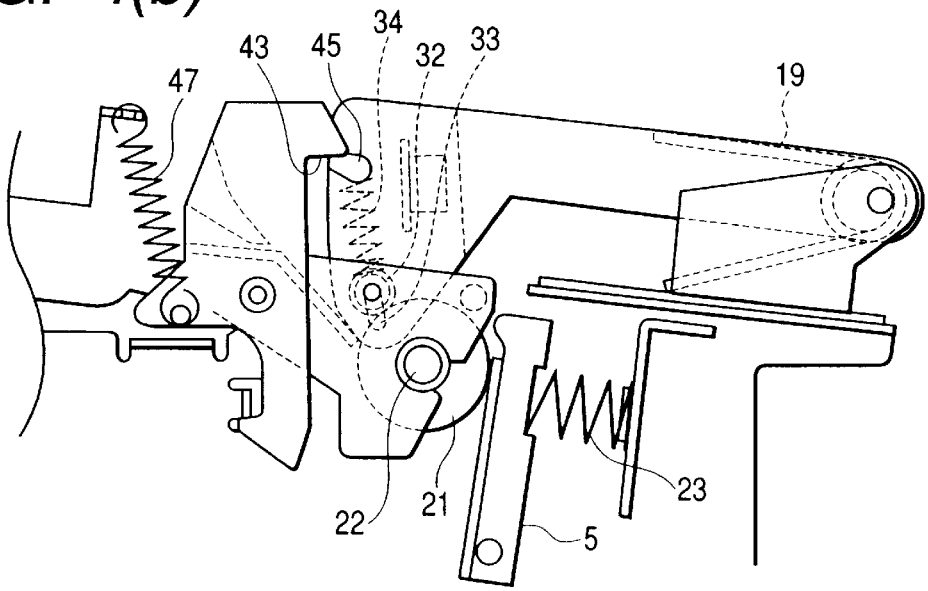

FIGS. 3 (*a*) and (*b*) respectively show plan and partial side views of the first cover frame 13, whereas FIGS. 4 (*a*) and (*b*) respectively show plan and partial side views of the second cover frame 16. The structure of the first and second swing covers 11 and 12 will now be described with reference to the drawings.

The first cover frame 11 is rectangular in shape, and the proximal end thereof is rotatably supported by the first axis 15.

The second cover frame 16 is also rectangular in shape, and a proximal end thereof is rotatably supported by a second axis 18 bridged to the main frame 8 in the width direction. Further, the second swing cover 12 is urged toward an open direction by a twisted coil spring 19 mounted on the second axis 18.

The first cover case 14 and the second cover case 17 form a case cover which closes the opening 6 in the main case 7.

A platen roller 21 is arranged along the printer width at a tip end of the first cover frame 13 so that both ends of the roller 21 are rotatably supported. When the first swing cover 11 is closed, the platen roller 21 presses against the thermal head 5. The thermal head is pivoted into pressing engagement with the platen roller 21 by a compressed coil spring 23. The tip ends of the first cover case 14 and the second cover case 17 are confronted with each other when they are closed, and each has a rectangular notch so that together they form an opening 24 for discharging a label sheet. A first sheet-discharging guide portion 25*a* is formed on the first cover case 14, at one end of the opening 24, so that it extends along the printer width direction. A second sheet-discharging guide portion 25*b* is formed at the other end of the opening 24 and extends in the printer width direction. Further, the printer body contains third and fourth sheet discharging guide portions 25*c* and 25*d* for guiding the base sheet 2*a* toward the first sheet-discharging guide portion 25*a*. As shown in FIGS. 3(*a*) and (*b*), the third and the fourth sheet-discharging guide portions 25*c* and 25*d* are bridged in the printer width direction at the tip end of the first cover frame 13.

Label Separating Mechanism

FIGS. 5 to 9 are perspective views showing a sequence of steps from the open condition of the first and second swing covers to the close condition thereof. With reference to these drawings, next will be described the structure by which a label, after printing, is separated from the base sheet 2*a* of the label sheet 2.

According to the label separating mechanism of this embodiment, there is provided a first guide member 31 serving as sheet-curving roller extending in the printer width direction at a tip end of the first cover frame 13, and a second guide member 32 serving as a sheet-pressing roller extending in the printer width direction at a tip end of the second cover frame 16.

The first guide member 31 is rotatably supported and adjunctively positioned above the platen roller 21. Namely, upon closing the first swing cover 11, the first guide member 31 is positioned at a side to which the label—after having passed between the thermal head 5 and the platen roller 21—is fed. On the other hand, the second guide member 32 is positioned on the second cover frame 16 such that the second guide member 32 is positioned at the same side of the thermal head 5 as is the first guide member 31, but is spaced farther from the thermal head than is the first guide member 31. Further, the second guide member 32 is positioned at the same height as is the first guide member 31. Moreover, the second guide member 32 is designed to slidably move along an elongate hole 33 formed on the second cover frame 16 in an approximately vertical direction.

A label separating operation, as performed by the above-described structure, will be described hereinbelow.

The label sheet 2 is fed from the accommodating portion 4 so that it passes, in an upward direction as shown in the Figures, between the thermal head 5 and the platen roller 21. The label 2*b* facing the thermal head 5 is printed with a predetermined character or the like. After printing, only the base sheet 2*a* travels through the first guide member 31 and under the second guide member 32. Then, the base sheet 2*a* is discharged from the opening 24, which is formed by the tip ends of the first cover case 14 and the second cover case 17. The base sheet 2*a* is wound, by the second guide member 32, to define an angle larger than a right angle with respect to the first guide member 31. Thus, at this position, the label 2*b* is transported in a label travel direction (upper direction in the Figure) due to the high label 2*b* stiffness so that it separates from a surface of the base sheet 2*a*.

In this embodiment, the second guide member 32 is urged by a compressed coil spring 34 so as to apply a predetermined tension to the base sheet 2*a* and, thereby, wind the base sheet 2*a* about the first guide member 31. Thus, the label 2*b* surely is separated from the base sheet 2*a* at this position.

Swing Cover Lock Mechanism

Next, with reference to FIGS. 1 to 9, the lock mechanism will be explained. The lock mechanism locks the first and second swing covers 11 and 12, as shown in FIGS. 1 and 2, in a closed state.

The lock mechanism of the present invention contains a lock lever 41 mounted on a side of a tip end of the first cover frame 13. The lock lever 41 is rotatably supported on the first cover frame 13 by a rotation axis which is located at an intermediate position of the lock lever 41. The lock lever 41 contains a link portion 41*a* and a lever body 41*b*. The link portion 41*a* extends in the printer width direction. The lever body 41*b* is curved in a right angle from both ends of the link portion 41*a*, and extends in a longitudinal direction as shown in FIGS. 3(*a*) and (*b*). The lock lever 41 also contains a cover-engagement surface 43 on an upper portion thereof, and a main-body-engagement surface 44 on a lower portion thereof. The cover-engagement surface 43 is engageable with the second swing cover 12, and the main-body-engagement surface 44 is engageable with the main frame 8.

Both side surfaces on the tip end of the second cover frame 17 contain a first lever-engagement projection 45, which is engageable with the cover-engagement surface 43 from a lower side. Also, a second lever engagement projection 46 is engageable with the cover-engagement surface 43 from an upper side, and is provided on a surface of the side plate of the main frame 8.

Further, the lock lever 41 is always urged in a clockwise direction by a tension spring 47. However, the lock lever can not rotate beyond a condition as shown in FIG. 5 due to the presence of a stopper (not shown).

Figure 5:
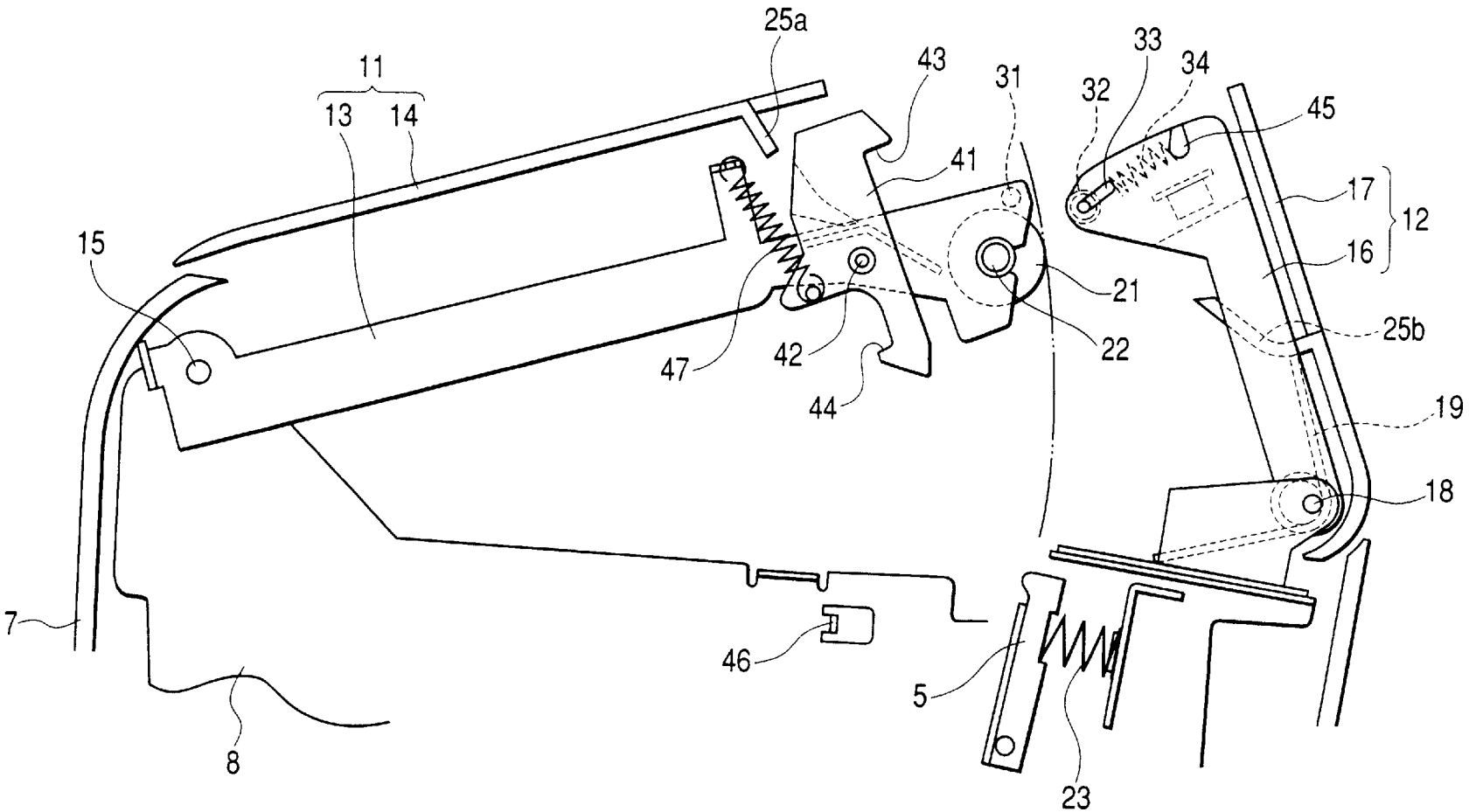
FIG. 5 is a side view showing both swing covers, of the printer in FIG. 1, open.
Figure 6:
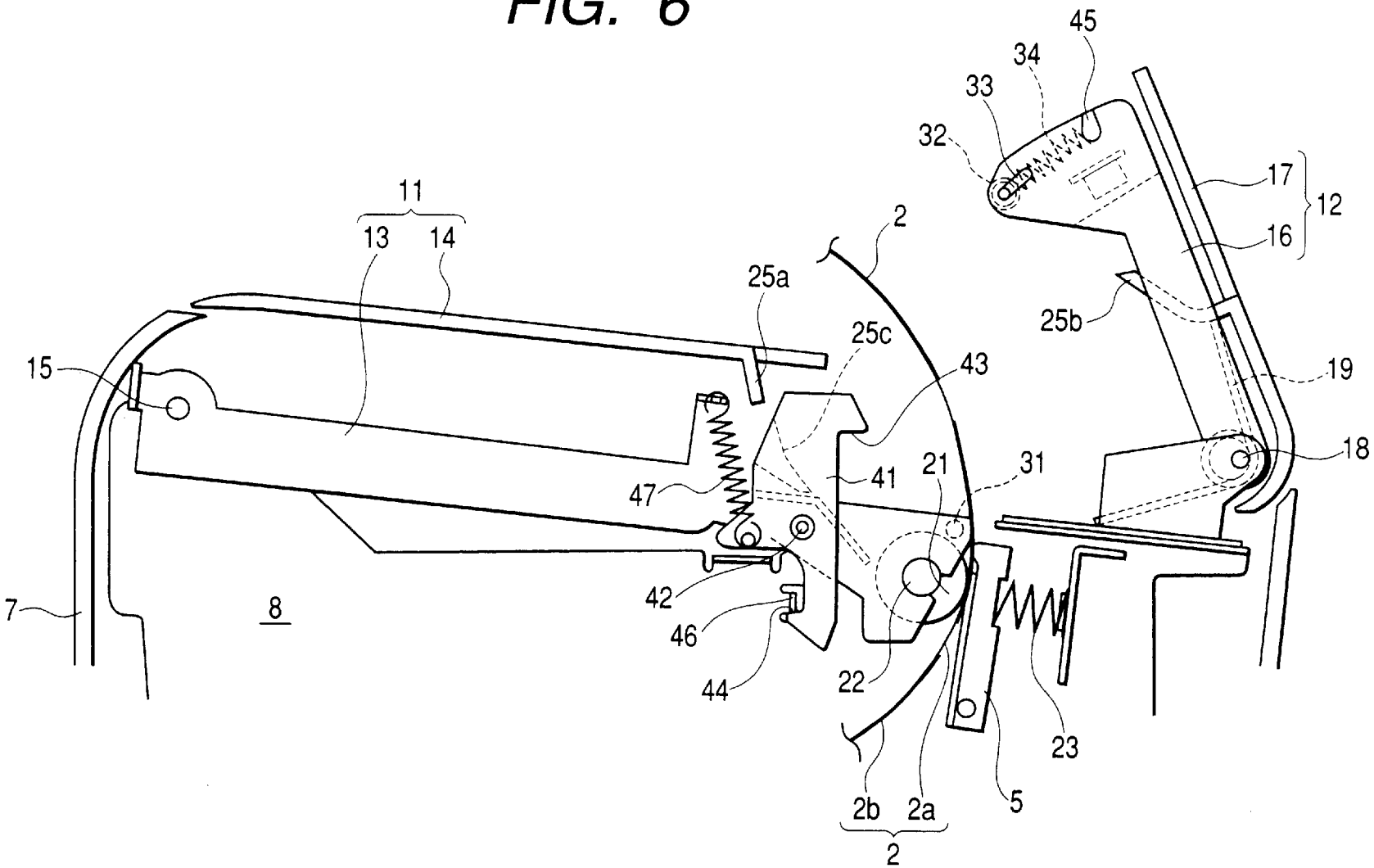
FIG. 6 is a side view showing a condition wherein the first swing cover, of the printer in FIG. 1, is closed.

In this configuration, if only the first swing cover 11 is closed from the open configuration as shown in FIG. 5, the lock lever's main body engagement surface 44 is brought into contact with the second lever engagement projection 46. After that, the lock lever 41 slightly rotates in a counterclockwise direction against the spring tension, and runs over the second lever engagement projection 46. As a result, as shown in FIG. 6, the first swing cover 11 is locked because the second lever engagement projection 46 is engaged with the main body engagement surface 44 from the lower side.

Figure 8:
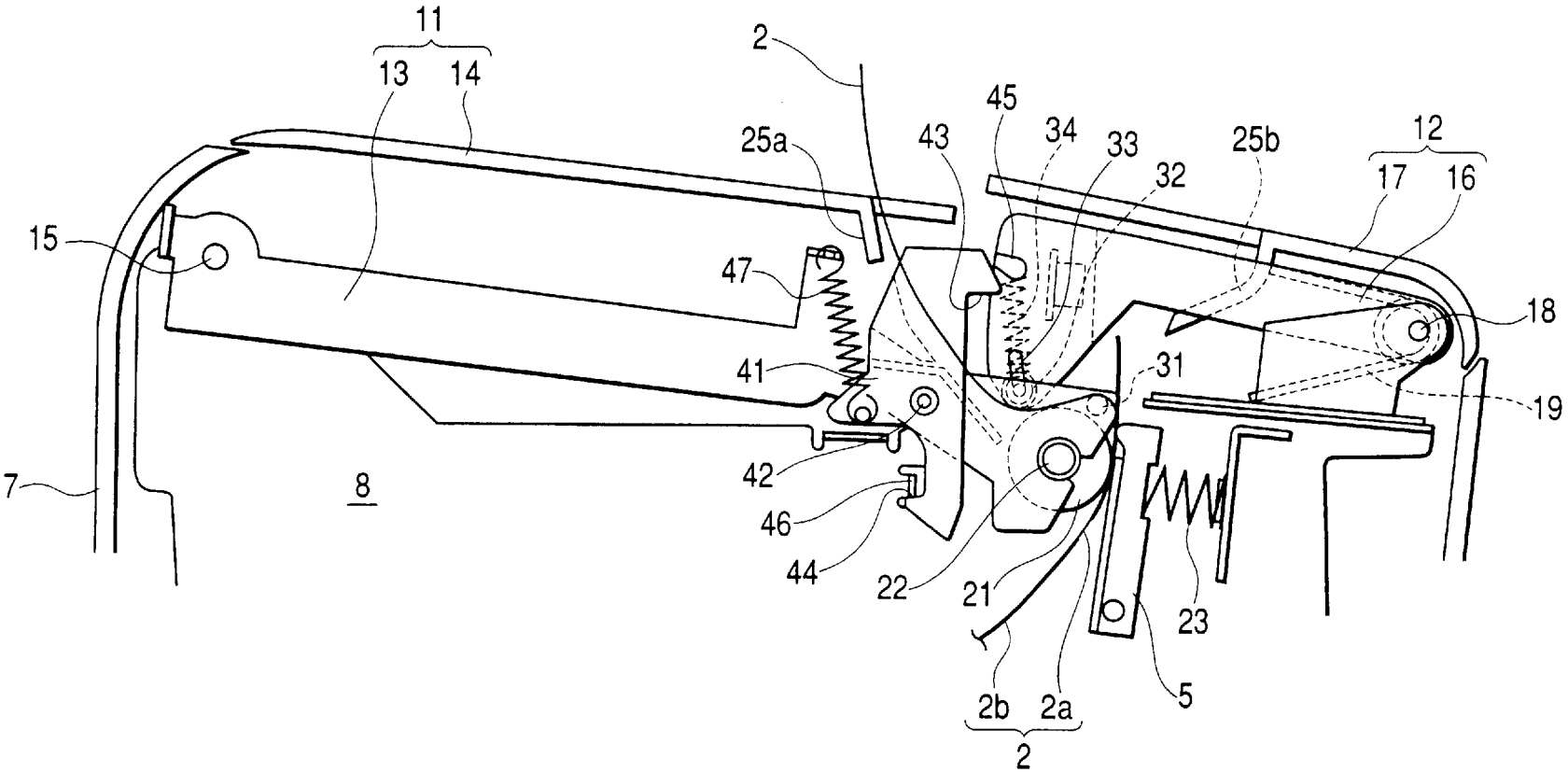
FIG. 8 is a side view showing the second swing cover in contact with a lock lever of the printer in FIG. 1.
Figure 9:
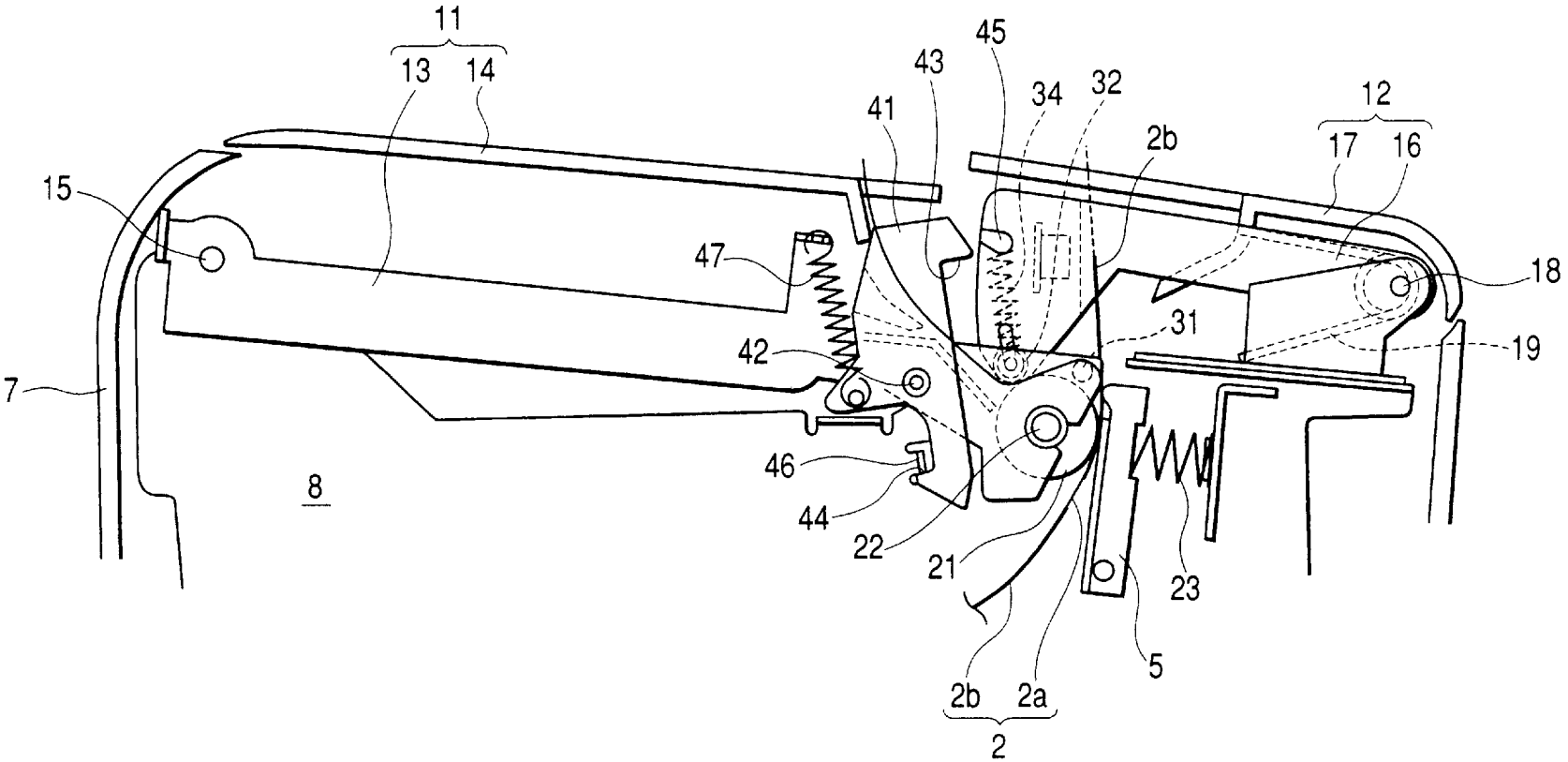
FIG. 9 is a side view showing the second swing cover almost completely closed, i.e., just before the condition shown in FIG. 1.

Next, when the second swing cover 12 is closed, the first lever engagement projection 45 is brought into contact with the upper end portion of the lock lever 41 as shown in FIG. 8. As shown in FIG. 9, when the second swing cover 12 is further pressed, the lock lever 41 slightly rotates in the counterclockwise direction against the spring tension so as to allow the swing cover 12 to completely close. At the completely closed condition, the first lever engagement projection 45 is positioned under the cover engagement surface 43. As a result, the lock lever 41 rotates in the clockwise direction—due to the spring tension—so that the second swing cover 12 is locked because the first lever engagement projection 45 is engaged with the cover engagement surface 43 from the under side.

To unlock the first 11 and second 12 swing covers, the lock lever 41 rotates in the counterclockwise direction around an axis 42 in the direction of arrow A as shown in FIG. 3(*b*). For example, there is a manual operation lever, mounted on an outside surface of the printer body, which could rotate the lock lever 41. Then, this manual operation lever is rotated in the counterclockwise direction to turn the lock lever 41. When the lock lever 41 rotates in the direction of arrow A against the spring force, it disengages the lock lever 41 from the second lever engagement projection 46, and brings the lock lever's contact surface 41*c* into contact with the support surface 41*d* provided with the printer main body frame so as to lift up the first cover frame 13. As a result, even if the manual operation lever is released to return the lock lever to its initial position, the first swing cover 13 is not locked again.

Recording Rolled Paper Loading

Next, this label printer 1, a rolled-paper loading operation will described.

First, from the condition shown in FIGS. 1 and 2, the lock lever 41 is slightly swung—by a manual operation lever (not shown)—in the counterclockwise direction. As a result, the lock lever 41 releases the locked condition so that the first and second swing covers 11 and 12 can be opened. In this embodiment, the second swing cover 12 is always urged, by a twist spring 19, in an open direction around an axis 18. Thus, as shown in FIG. 5, when the lock is released, the second swing cover 12 is firstly placed in a full open condition by a spring force.

Next, the first swing cover 11 is opened. FIG. 5 shows a half open condition of the first swing cover 11. After fully opening the first swing cover 11, the recording rolled paper 3 is loaded in the accommodating portion 4. After that, the label sheet 2 is fed from the recording rolled paper 3, and is pulled out of the opening 6 toward the upper direction. Under this condition, the first swing cover 11 is closed.

When the first swing cover 11 partially is closed to certain degree, the lower end portion of the lock lever 41 is brought into contact with the second lever engagement projection 46. Next, as described above, the lock lever 41 is slightly swung, by further movement of the first swing cover 11, against the pulling force of a coil spring 47 to run over the second lever engagement projection 46. Then, the lock lever's main body engagement surface 44 is engaged with the lower side of the second lever engagement projection 46 from the lower side so that the first swing cover 11 is locked in a completely closed condition.

As shown in FIG. 6, when the first swing cover is completely closed, the label sheet 2 is interposed between the platen roller 21 and the thermal head 5. At this time, a fed portion of the recording rolled paper 3 travels between the thermal head 5 and the first guide member 31. Thus, the recording rolled paper 3 is rolled to a side of the first swing cover 11 due to a curl out so as to face the tip end portion of the second swing cover 12 which is open.

Figure 7:
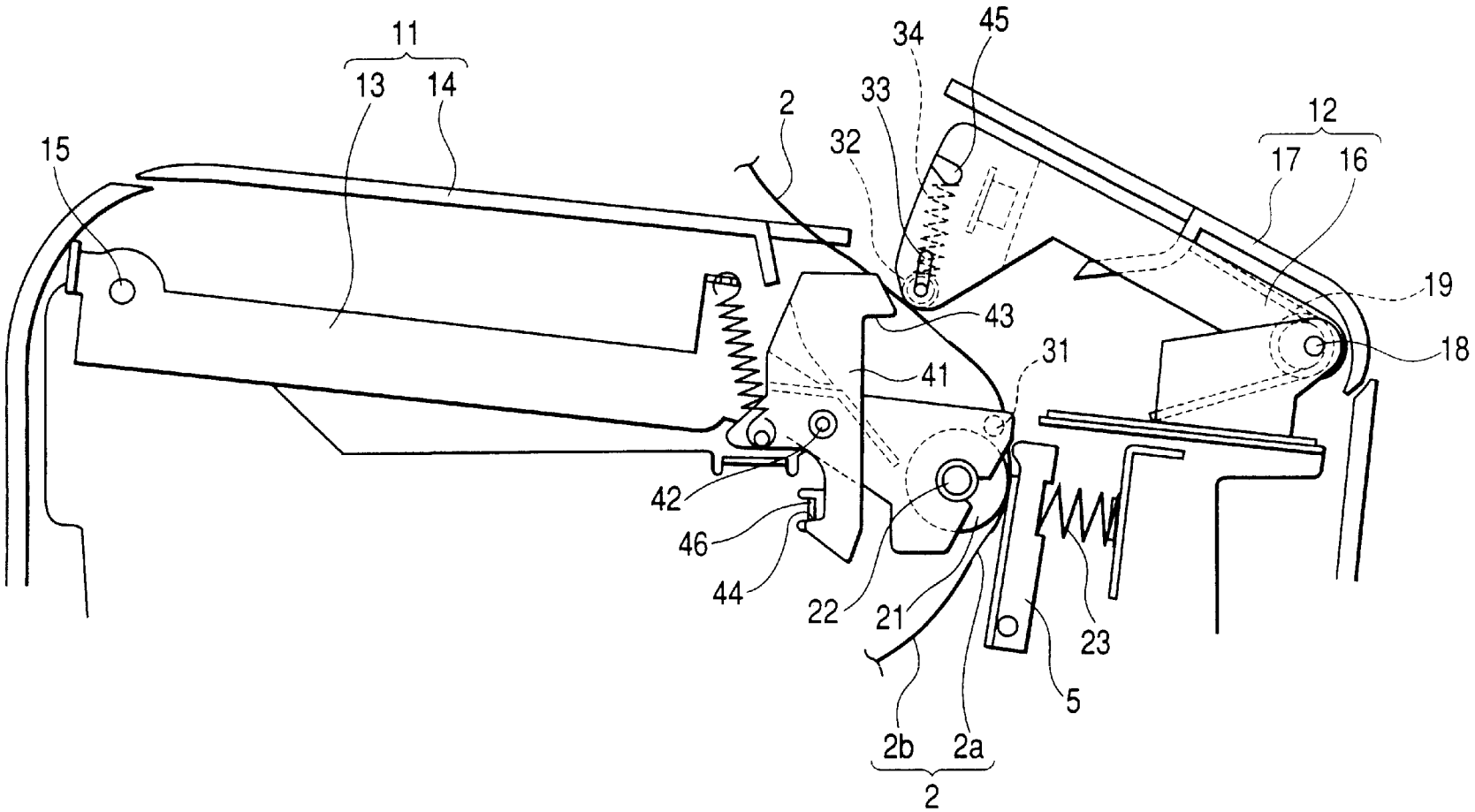
FIG. 7 is a side view showing the second swing cover, of the printer in FIG. 1, partially closed.

Next, when the second swing cover 12 is gradually closed, as shown in FIG. 7, the part of the label sheet 2, which is fed to the upper side, is pressed downward by the second guide member 32. The second swing cover 12 is further closed, as shown in FIG. 8, so that the second guide member 32 approaches the platen roller 21 and presses the label sheet 2 toward a side of the platen roller 21. As a result, the label paper 2 is wound with an angle more than a right angle with respect to the first guide member 31 and is rolled downwardly at this position.

As shown in FIG. 8, after the first lever engagement projection 45, of the second swing cover 12, contacts with the upper end portion of the lock lever 41, the lock lever 41 is slightly swung—by further closing of the second swing cover 12—in the counterclockwise direction against the spring force. As a result, as shown in FIG. 9, the lock of the first swing cover 11 by the lock lever 41 is temporarily released. But after passing the second lever engagement projection 46 over the upper portion of the lock lever 41, the lock lever is swung by spring force in the clockwise direction to again lock the first swing cover 11.

As a result, as shown in FIG. 1 and 2, the second lever engagement projection 46 is engaged with the lock lever's main-body-engagement surface 44, and the cover-engagement surface 43 is engaged with the first lever engagement projection 45 so as to lock the first and second swing covers 11 and 12.

At the same time, the fed portion of the label sheet 2 is automatically fed from the opening 24 by way of the curved transporting path which extends around the first guide member 31 and the second guide member 32.

As described above, after finishing the recording-rolled-paper loading operation, the thermal head 5 is swung towards the platen roller 31 so that it can print on the labels 2*b*.

At this time, the base sheet 2*a* is transported so that it is curved with an angle more than 90 degrees with respect to the first guide member 31. The base sheet 2*a* is curved so that the label 2*b* is attached to the outer radial surface of the curved base sheet 2*a*. Thus, the label 2*b* is separated from the base sheet by its own stiffness and is transferred to the upper side of the printer.

If plain paper is fed into the accommodating portion 4, it is arranged to discharge through the same transporting path as that of the base sheet 2*a*. Instead of this arrangement, however, the plain paper may be arranged to directly discharge from the opening 24 as does the label 2*b*—i.e., without traveling through the label separating mechanism.

According to the printer 1 of this embodiment of the present invention, by merely closing the first and second swing covers 11 and 12, the following condition is automatically accomplished: the label sheet 2, fed from the recording rolled paper 3, is traced along the label separating mechanism defined by the first guide member 31 and the second guide member 32, and further is fed from the opening for discharging the base sheet. Therefore, the operator only closes the first and second swing covers 11 and 12 after loading the recording rolled paper into the accommodating portion 4. Thus, the recording-rolled-paper loading operation is accomplished by a simple operation without troublesome effort.

Further, the same operation could be applied to plain paper so that the operator does not need to determine whether label sheet or plain paper is being loaded into the printer 1. Thus, ease in operability is enhanced.

Next, according to the printer 1 of this embodiment of the present invention, if the second swing cover 12 were to be closed prior to closing the first swing cover 11, the swing covers 11, 12 would not be locked in the closed position. Instead, they would again be opened by action of the twist spring 19. Thus, the operator must first close the first swing cover 11. As a result, the recording rolled paper properly is fed to ensure that the label 2*b* is separated from the base sheet 2*a*.

Further, according to the printer 1 of the present invention, the single lock lever 41 locks both the first and second swing covers 11 and 12. Therefore, once the lock lever 41 is moved in a counterclockwise direction, both the first and second swing covers 11 and 12 are unlocked. Thus, the opening operation of the first and second swing covers 11 and 12 is simplified.

Furthermore, according to the printer 1 of the present invention, the mechanism for covering opening 6 is constituted by the first and second swing covers 11 and 12, i.e., two swing covers which pivot in opposite directions when moving away from a closed position in which they are relatively close to each other. Thus, as compared with a single swing cover for covering the opening 6, the opening/closing space for the swing cover is decreased.

Further, in the printer 1 of the present invention, the label separating mechanism is constituted of the first guide member 31 and the paper-pressing roller 32. Of course, the label separating mechanism could be constituted of only the paper-pressing roller 32. In such a case, the base sheet 2*a* is pressed so as partially to circumscribe the platen roller 21 thereby curving the base sheet 2*a*.

Furthermore, in this embodiment, the lock lever 41 rotates around the axis 42 to lock/unlock the first and second swing covers 11 and 12. However, it is possible for the lock lever 41 to move linearly or with a complex movement—i.e., combined linear and rotational movements—to lock/unlock the first and second swing covers 11 and 12.

In this embodiment, the lock lever 41 is arranged on the first swing cover 11. But it is possible to arrange the lock lever 41 on the second swing cover 12.

Second Embodiment

Figure 10A:
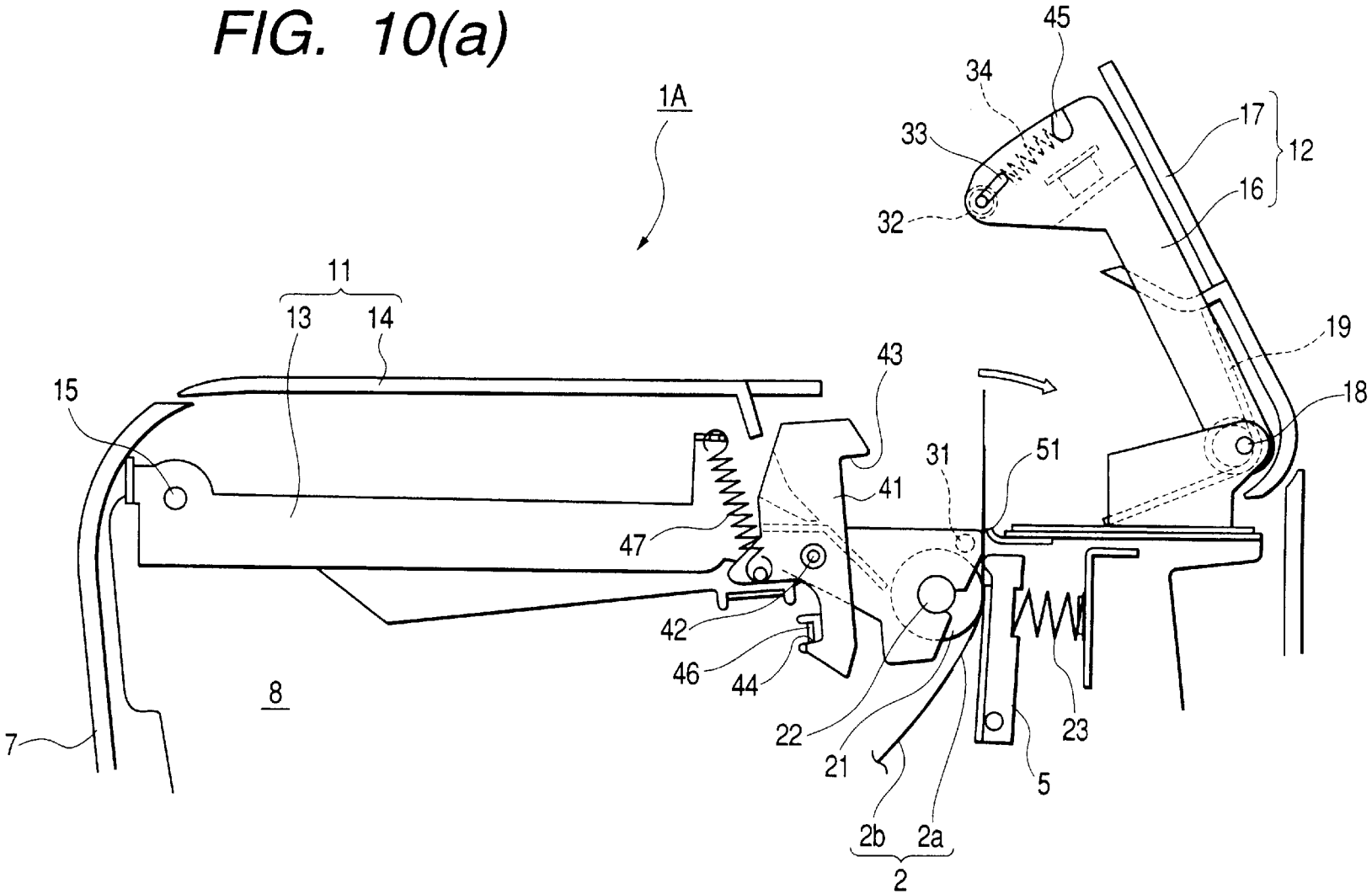
FIGS. 10 (*a*) and (*b*) are partial cross sectional views of another embodiment of the present invention.
Figure 10B:
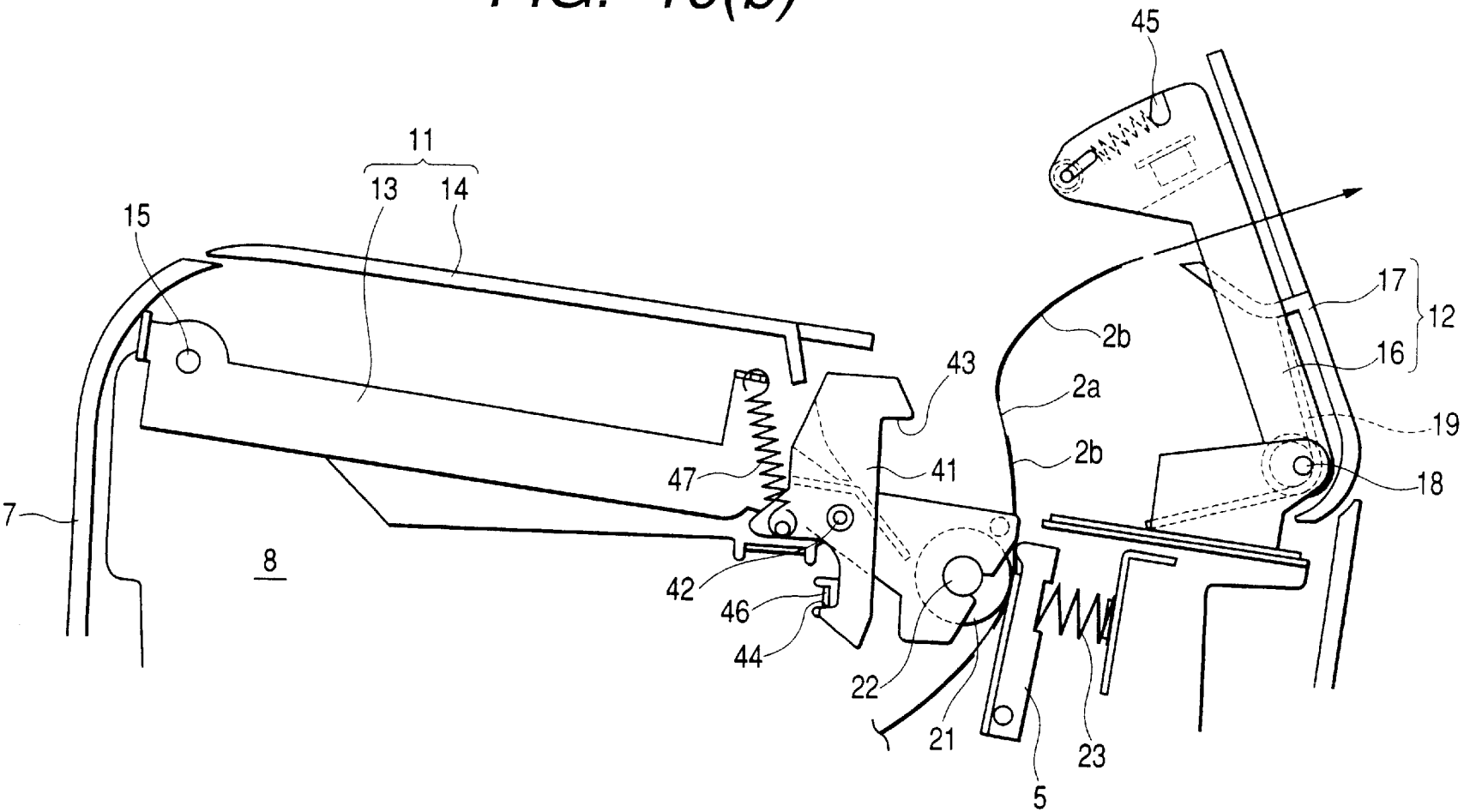

FIGS. 10 (*a*) and (*b*) are partial perspective sectional views of a modified embodiment of the present invention. The main portions of the printer 1A are the same as those of the printer 1. Thus, the same reference numerals are applied to the printer 1A to designate like parts and only the different portions will be described below.

The printer 1A includes a cutter blade 51 for cutting the label sheet 2 after the printing operation. The cutter blade 51 is provided on a label-sheet feeding side with respect to the thermal head 5 and the first guide member 31.

Further, upon closing the first swing cover 11, the cutter blade 51 faces the first guide member 31 with a small gap defined therebetween.

With this construction, it is possible to perform a printing operation on a plurality of the labels 2*b* adhered on the base sheet. Namely, after loading the recording rolled paper 3 into the accommodating portion 4, the first swing cover 11 is closed, the label sheet 2 is fed and curled toward the first swing cover 11 as shown in FIG. 6. Then, the second swing cover 12 is closed, and the fed portion of the label sheet 2 is arranged along the transporting path defined by the label separating mechanism with the curled portion. Thus, the fed portion of the label sheet 2 will pass through the second swing cover 12 which is opened as shown in FIG. 10(*b*).

Advantageously, however, according to the printer 1A of the present invention, it is unnecessary to employ the feed operation. Namely, after closing the first swing cover 11, the fed portion of the label sheet 2 cut along the cutter blade 51, then the second swing cover 12 is closed. Upon starting the printing operation, the label sheet 2 fed from the thermal head 5 and the platen roller 31 is transported in upward direction to discharge it from the opening for discharging the base sheet.

Figure 11:
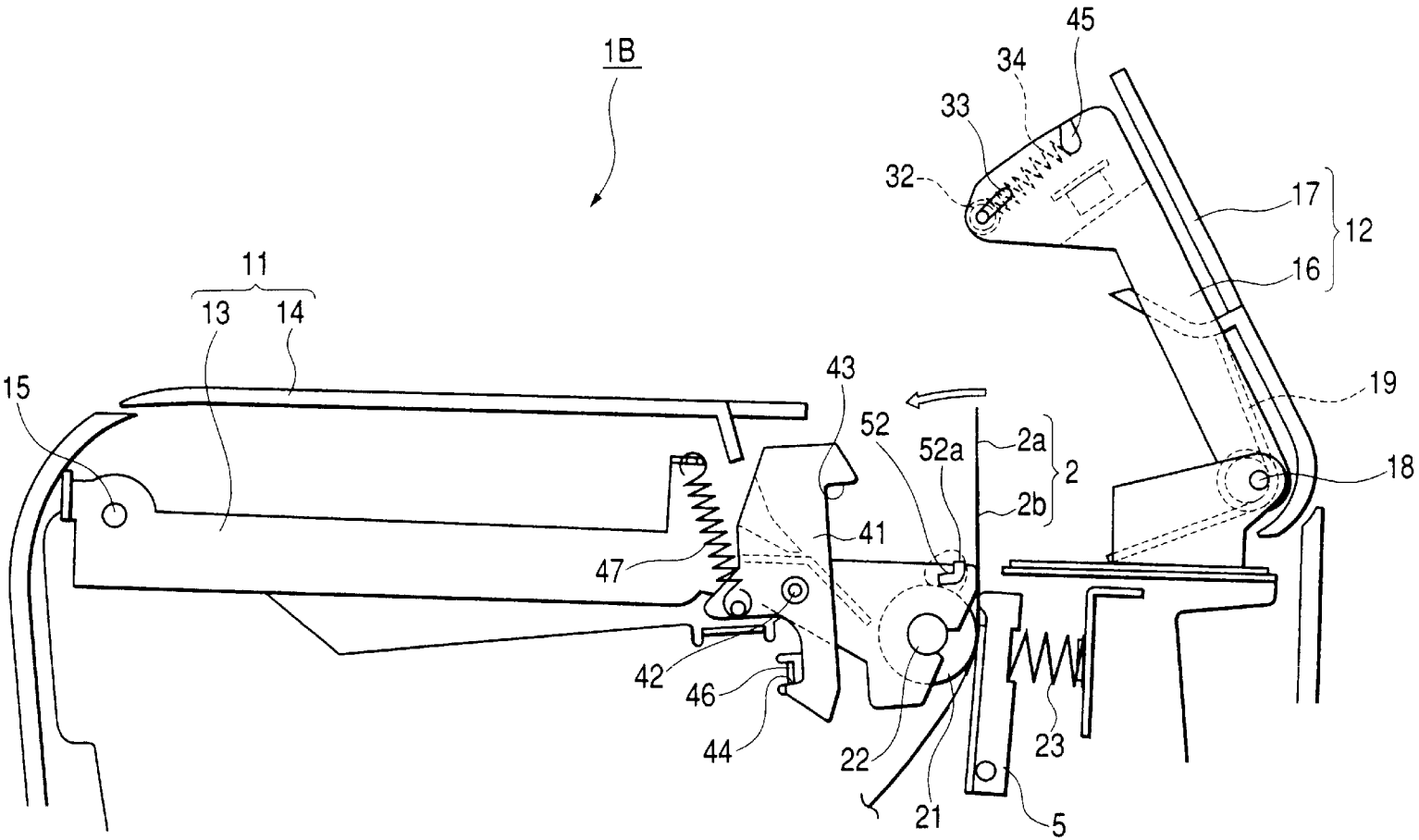
FIG. 11 is a partial cross sectional view of modified embodiment of FIG. 10.

The cutter blade 51 is used in the same manner as the first guide member 31. As shown FIG. 11, the printer 1B has a structure described above. The main portions of the printer 1B are the same as those of the printer 1. Thus, the same reference numerals are applied to the printer 1A to designate like parts and only the different portions will be described below. As shown in this figure, in the printer 1B, a first guide member 52 in an L-shape at a cross sectional view is positioned at a position of the first guide member 31. An upper surface edge of the first guide member 52 at the second swing cover side serves as a sharp cutter blade 52*a*.

Advantageously, however, according to the printer 1B as same as the printer 1A, it is unnecessary to employ the feed operation when the printing operation is performed so that a plurality of labels are not separated from the base sheet.

Further, the first guide member 31 and the cutter blade 51 are provided with a uniform member so that the structure is simplified and the manufacturing cost is reduced.

Figure 12:
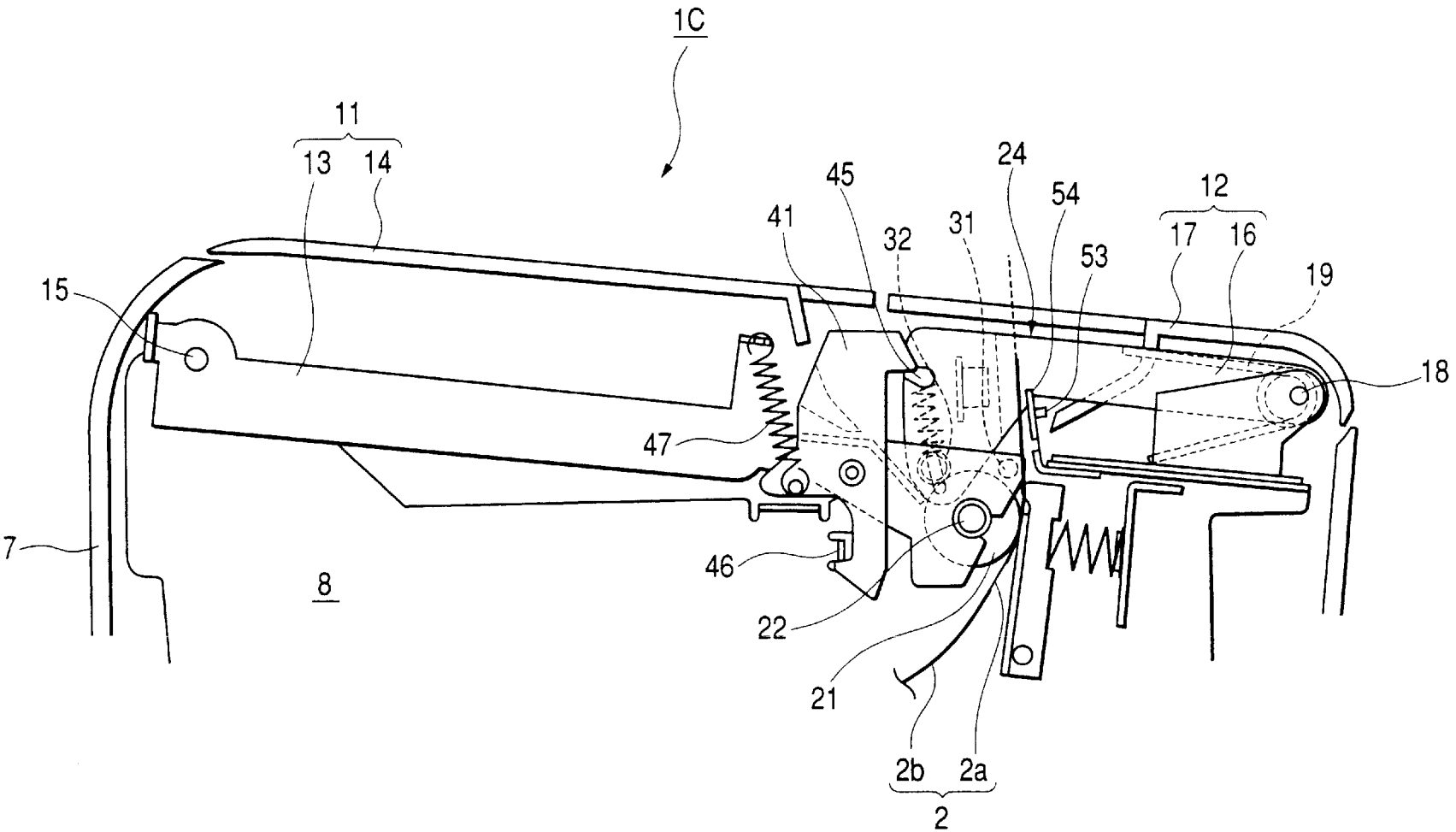
FIG. 12 is a partial cross sectional view of a second modified embodiment of FIG. 10.

A printer 1C, as shown in FIG. 12, employs a cutter blade such that the label sheet 2 is easily cut when the second swing cover 12 is closed. The main structure of printer 1C is the same as that of the printer 1. The printer 1C contains a metal plate 53 curved in L-shape, which has an erected portion serving as the cutter blade 54. The cutter blade 54 is positioned such that it does not interfere with any of the parts of the second swing cover 12.

In the printer 1C, the cutter blade 54 is arranged adjacent to the opening 24 for discharging the sheet. Thus, it is easy to cut the label sheet 2 upon closing the second swing cover 12.

Third Embodiment

Lock Mechanism Modification

Figure 13A:
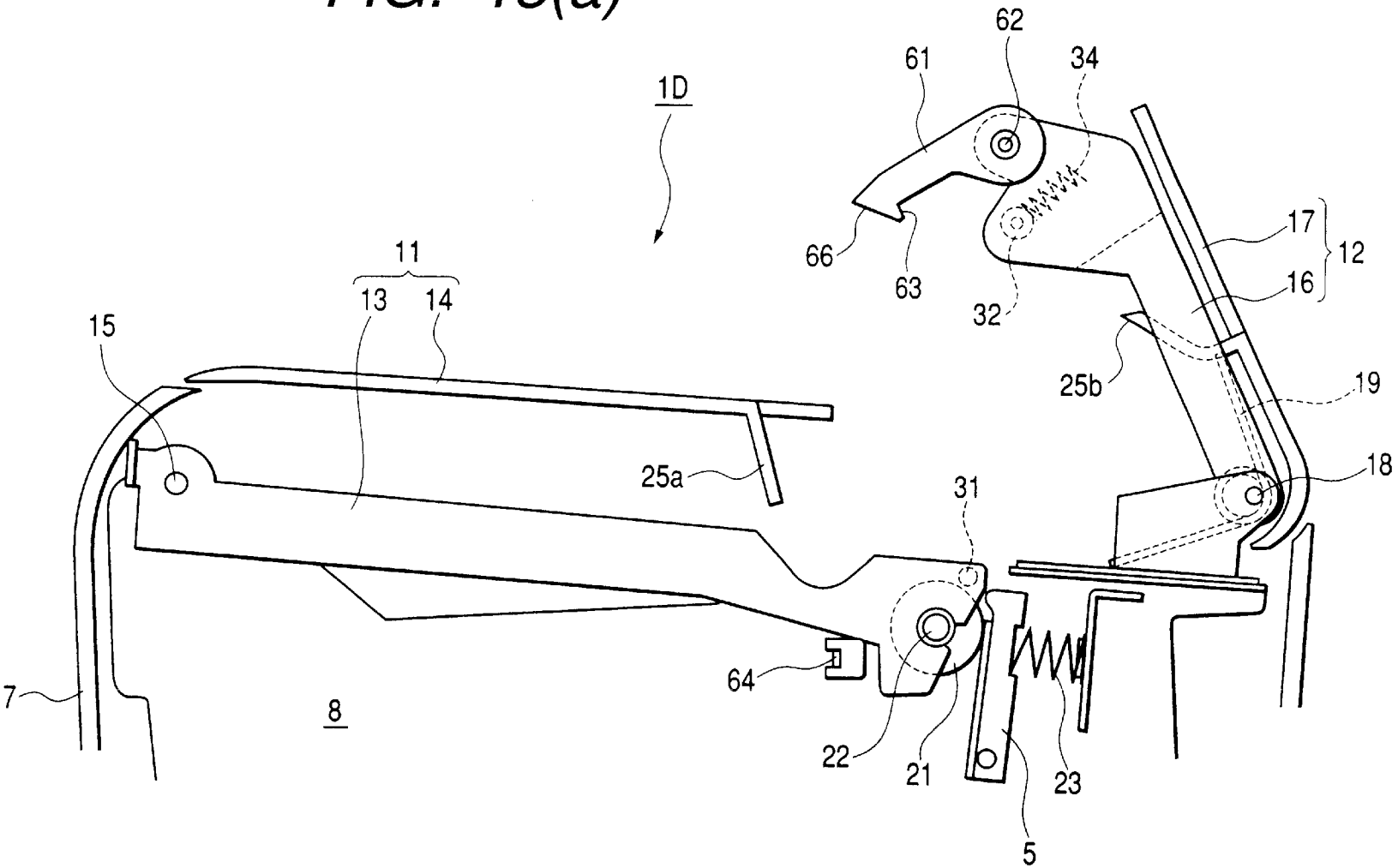
FIGS. 13 (*a*) and (*b*) are partial cross sectional views of a third embodiment of the present invention.
Figure 13B:
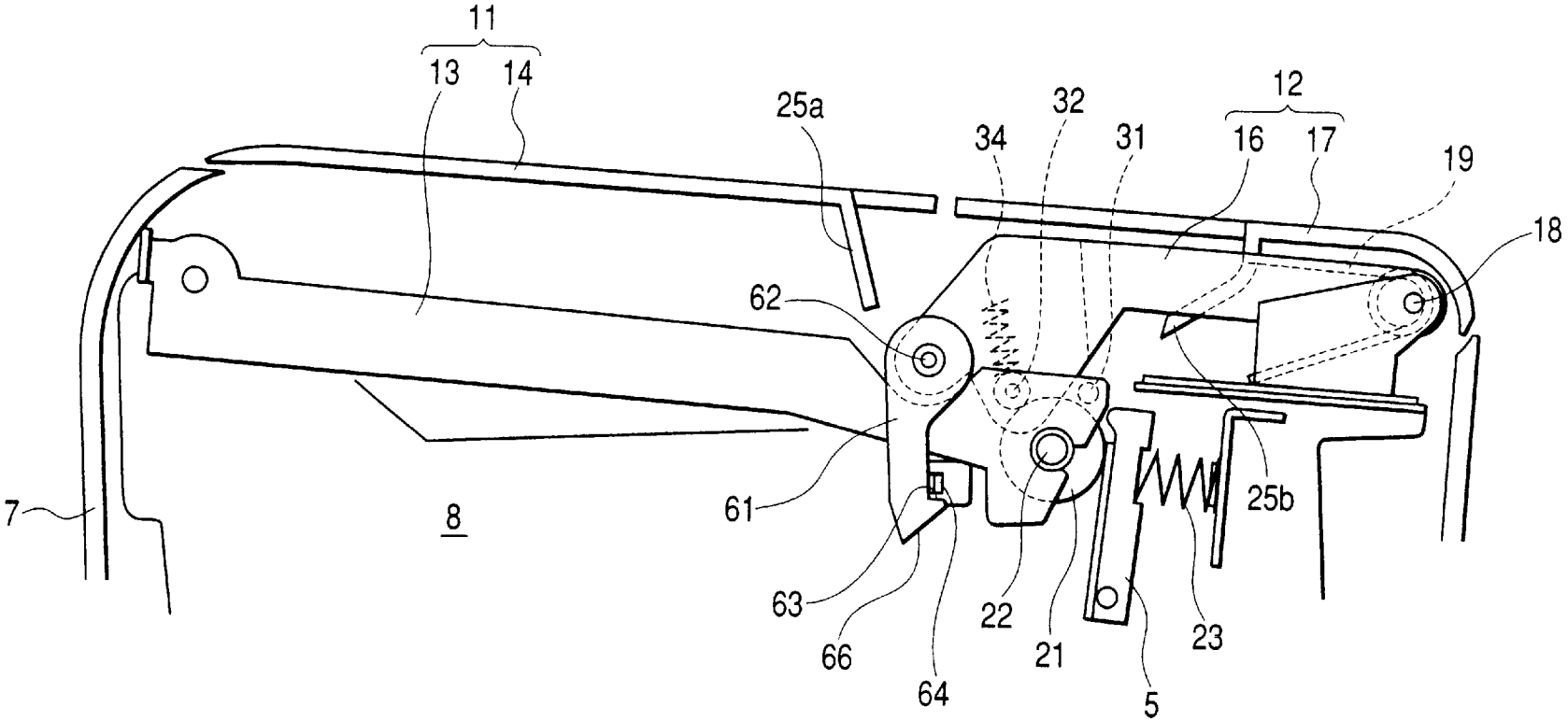

FIG. 13 shows a perspective view of a printer with a lock mechanism that is different from the lock mechanism of the printer 1. A printer 1D has a structure substantially the same as that of the printer 1. The difference therebetween is the lock mechanism for locking the first and the second swing covers in the closed position. Thus, only the lock mechanism of printer 1D is described below.

The lock mechanism of the printer 1D contains a lock lever 61 mounted on a tip end portion of the second cover frame 16. The lock lever 61 rotates around an axis 62, and is always urged in the counterclockwise direction by a twist coil spring (not shown). The lock lever 61 contains a body engagement surface 63 at a tip end thereof. Further, the main frame 8 contains a lever engagement projection 64 for engaging with the body engagement surface 63.

When the second swing cover is gradually closed, a slant tip surface 66 of the lock lever 61 is brought into contact with the lever engagement projection 64. Then, the lock lever 61 is slightly rotated in the clockwise direction against the spring force. As a result, as shown in FIG. 13 (*b*), the body engagement surface 63 of the lock lever 61 is engaged with the lever engagement projection 64 on the main frame.

Further, according to this embodiment, the second guide member 32 mounted in the second swing cover 12 is pressed to circumscribe the platen roller 21 when the second swing cover 12 is closed.

In this embodiment, the first swing cover 11 is closed, and the platen roller 21 attached with the tip end thereof is positioned adjacent the thermal head 5 as shown in FIG. 13 (*a*). Then, the first swing cover is maintained in the closed position by the spring force of the compression spring 23 pressing the thermal head 5.

Next, when the second swing cover 12 is closed, the lock lever 61 mounted on the tip end thereof is engaged with the lever engagement projection 64 to lock the second swing cover 12. In this condition, the platen roller 21 mounted on the first swing cover 11 is pressed toward a swing cover close direction by the second guide member 32 mounted on the second swing cover 12 which is locked. Thus, when the second swing cover 12 is locked, the first swing cover 11 □ is automatically locked in the closed position.

In the printer 1D, when the second swing cover 12 is firstly closed—rather than the first swing cover 11 being firstly closed—the second swing cover 12 is not positioned in the cover lock position. Thus, the second swing cover 12 is opened again by the spring force of the twist coil spring 19. The operator is thus forced to operate the first swing cover 11 to be firstly closed. As a result, the recording rolled paper 3 is fed so that the label 2*b* surely is separated from the base sheet 2*a*.

Further, the single lock lever 61 locks both the first and second swing covers 11 and 12. Therefore, the lock lever 61 can be operated so that both the first and second swing covers 11 and 12 are unlocked. The opening operation of the first and second swing covers 11 and 12 is thus simplified.

The embodiments described above employs the feature that the first and second swing covers 11 and 12 are rotatably supported by the first and second axes 15 and 18 bridged to the main frame. Of course, the present invention is not limited by this structure. It is capable for providing an elongated hole for movably supporting the first and second axes 15 and 18, or for providing a link mechanism for supporting the first and second swing covers 11 and 12.

Advantages of the Present Invention

As described above, according to the present invention, upon merely closing the first and second swing covers, the following condition is automatically accomplished: the label sheet fed from the recording rolled paper 3 is traced along the label separating mechanism and is fed from the opening for discharging the base sheet. Therefore, the operator only closes the first and second swing covers after loading the recording rolled paper into the accommodating portion. Thus, the recording-rolled-paper loading operation is accomplished simply, without trouble.

Further, the second guide member 32 is pressed by the spring 34 toward the label side so that the label is curved with a predetermined tension so that it surely separates from the base sheet.

Further, if the second swing cover 12 were to be closed prior to closing the first swing cover 11, the swing covers 11, 12 would not be locked in the closed position. Thus, the operator is forced to firstly close the first swing cover 11. As a result, the recording rolled paper is fed so as surely to separate the label 2*b* from the base sheet.

Further, according to the printer of the present invention, a single lock lever locks both the first and second swing covers. Therefore, the lock lever can be operated to unlock both the first and second swing covers. The opening operation of the first and second swing covers is thus simplified.

Furthermore, the second swing cover is always urged toward the open direction by the spring force. Thus, when the second swing cover is firstly closed, or the lock of the second swing cover is released, the second swing cover is automatically opened. Therefore, the second swing cover opening operation is simplified.

Additionally, a cutter blade can be provided for cutting the label sheet. Thus, the label-sheet feed operation is simplified when the printing operation is performed so that a plurality of labels are not separated from the base sheet.

Further, when the cutter blade is commonly provided with the first guide member, the number of parts could be reduced to simplify the structure and to reduce the manufacturing cost.

Moreover, according to the present invention, the cover is defined by first and second swing covers—i.e., two swing covers which pivot in opposite directions when moving from the closed position in which they are relatively close to each other—so that the necessary space for the cover is minimized as compared with that of a single cover.

The present invention is not limited to the specific above-described embodiments. It is contemplated that numerous modifications may be made to the printer of the present invention without departing from the spirit and scope of the invention as defined in the following claims.

What is claimed is:

1. A printer comprising:

a printer body having an accommodating portion for accommodating a rolled paper;

an opening for loading the rolled paper into the accommodating portion;

first and second swing covers, for opening and closing the opening, the first and second swing covers being mounted to the printer body so as to move away from a closed position in which they are close to each other;

a printing head which prints on the paper fed from the rolled paper accommodated in the accommodating portion;

a platen member mounted on the first swing cover and confronted with the printing head when the first swing cover is closed;

a first guide member provided with the first swing cover, and positioned downstream, in a paper transporting direction, with respect to the printing head and the platen member; and a second guide member, provided with the second swing cover, the second guide member positioned in a vicinity of the first guide member when the first and second swing covers are closed, wherein the first and second guide members are positioned relative to each other such that the paper is deflected across the first guide member by an angle substantially larger than a right angle.

2. The printer as claimed in claim 1, wherein the first guide member is positioned on the same side of the platen member as is the printing head when the first and second swing covers are closed, and wherein the second guide member is positioned on the same side of the printing head as is the first guide member so that the first guide member is closer to the printing head than is the second guide member.

3. The printer as claimed in claim 1 further comprising:

a lock mechanism for locking the first and second swing covers in the closed position.

4. The printer as claimed in claim 3, wherein the lock mechanism comprises:

a lock lever mounted on one of the first and second swing covers;

a cover-side lever-engagement portion provided on the other one of the swing covers;

a main-body-side lever-engagement portion provided on the printer body;

a cover-side engagement portion, on the lock lever, for engaging with the cover-side lever-engagement portion when the first and second swing covers are closed; and a main-body-side engagement portion, on the lock lever, for engaging with the main-body-side lever-engagement portion when the first and second swing covers are closed.

5. The printer as claimed in claim 4, wherein the lock lever moves between:

a lock position wherein the cover-side engagement portion and the main-body-side engagement portion engage with the cover-side lever-engagement portion and the main-body-side lever-engagement portion, respectively; and an unlock position wherein the cover-side engagement portion and the main-body-side engagement portion disengage with the cover-side lever-engagement portion and the main-body-side lever-engagement portion, respectively, and the lock mechanism further comprises an elastic member for urging the lock lever to the lock position, a manual operating member for rotating the lock lever toward the unlock position against an urging force of the elastic member, and an urging member for urging the swing cover which is not provided with the lock lever in a swing-cover opening direction.

6. The printer as claimed in claim 3, wherein the lock mechanism contains a lock lever mounted on the second swing cover, a first-swing-cover pressing portion provided on the second swing cover, and a main-body-side lever-engagement portion provided on the printer body, wherein the lock lever has a main-body-side engagement portion for engagement with the main-body-side lever-engagement portion when the lock lever closes the second swing cover, and wherein the first-swing-cover pressing portion presses the first swing cover to the closed position when the second swing cover is closed.

7. The printer as claimed in claim 6, wherein the first-swing-cover pressing portion corresponds to the second guide member provided on the second swing cover, and the second guide member is adapted for pressing the platen member toward the closed position of the first swing cover when the second swing cover is closed.

8. The printer as claimed in claim 6, wherein the lock mechanism contains an urging member for urging the second swing cover to the open position.

9. The printer as claimed in claim 7, wherein the lock mechanism contains an urging member for urging the second swing cover to the open position.

10. The printer as claimed in claim 1, further comprising:

a cutter blade for cutting the rolled paper after it passes the printing head, wherein the cutter blade is positioned downstream of the printing head and the platen member.

11. The printer as claimed in claim 10, further comprising:

an opening for discharging the recording medium, the opening being formed by the first and second swing covers at a position adjacent the printing head and the platen member when the first and second swing covers are in the closed position, wherein the cutter blade is positioned adjacent to the opening for discharging the recording medium.

12. The printer as claimed in claim 10, wherein the cutter blade is formed on the first guide member.

13. The printer as claimed in claim 1, wherein the printing head portion is a thermal head, the platen member is a platen roller, and the platen roller is brought into contact with the thermal head when the first cover is in the closed position.

14. A printer comprising:

a printer body having an accommodating portion for accommodating a rolled paper;

an opening for loading the rolled paper into the accommodating portion;

first and second swing covers, for opening and closing the opening, the first and second swing covers being mounted to the printer body so as to move away from a closed position in which they are close to each other;

a printing head which prints on the paper fed from the rolled paper accommodated in the accommodating portion;

a platen member mounted on the first swing cover and confronted with the printing head when the first swing cover is closed;

a first guide member provided with the first swing cover, and positioned downstream, in a paper transporting direction, with respect to the printing head and the platen member; and a second guide member, provided with the second swing cover, the second guide member positioned in a vicinity of the first guide member when the first and second swing covers are closed, wherein the first and second guide members guide the paper so as to incurvate the paper on the first guide member, and wherein the second guide member includes:

a sheet-pressing roller adjustably mounted, on the second swing cover, in the sheet pressing direction; and an elastic member urging the sheet-pressing roller in the sheet pressing direction.

15. A printer comprising:

a printer body having an accommodating portion for accommodating rolled paper;

an opening for loading the rolled paper into the accommodating portion;

first and second swing covers for opening and closing the opening, the first and second swing covers being mounted to the printer body for movement between first and second cover closed positions and first and second cover open positions;

a printing head which prints on the paper fed from the rolled paper accommodated in the accommodating portion;

a platen member mounted on the first swing cover and confronted with the printing head when the first swing cover is moved to the first cover closed position;

a first guide member provided with the first swing cover and positioned downstream in a paper transporting direction with respect to the printing head and the platen member; and a second guide member provided with the second swing cover, the second guide member positioned in a vicinity of the first guide member when the first and second swing covers are moved to the first and second cover closed positions, respectively, wherein the first and second guide members are configured with respect to the first and second swing covers, respectively, to prevent the second swing cover from being moved to the second cover closed position before the first swing cover is moved to the first cover closed position.

16. A printer as claimed in claim 15, wherein the first and second swing covers are pivotally mounted to the printer body at respective pivots, and wherein the first guide member is disposed closer to the second swing cover pivot than the second guide member when the first and second swing covers are moved to the first and second cover closed positions, respectively.

17. A printer as claimed in claim 15, wherein the platen member is at least partially disposed between the first and second guide members.

18. A printer comprising:

a printer body having an accommodating portion for accommodating rolled paper;

an opening for loading the rolled paper into the accommodating portion;

first and second swing covers for opening and closing the opening, the first and second swing covers being mounted to the printer body for movement between first and second cover closed positions and first and second cover open positions;

a printing head which prints on the paper fed from the rolled paper accommodated in the accommodating portion;

a platen member mounted on the first swing cover and confronted with the printing head when the first swing cover is moved to the first cover closed position;

a first guide member provided with the first swing cover and positioned downstream in a paper transporting direction with respect to the printing head and the platen member; and a second guide member provided with the second swing cover, the second guide member positioned in a vicinity of the first guide member when the first and second swing covers are moved to the first and second cover closed positions, respectively, wherein the platen member is at least partially disposed between the first and second guide members.

19. A printer as claimed in claim 18, wherein the first and second swing covers are pivotally mounted to the printer body at respective pivots, and wherein the first guide member is disposed closer to the second swing cover pivot than the second guide member when the first and second swing covers are moved to the first and second cover closed positions, respectively.

* * * * *